United States Patent [19]

Keritsis et al.

[11] Patent Number: 4,625,737

[45] Date of Patent: Dec. 2, 1986

[54] FOAMED, EXTRUDED, TOBACCO-CONTAINING SMOKING ARTICLE AND METHOD OF MAKING THE SAME

[75] Inventors: Gus D. Keritsis; Walter A. Nichols; George H. Burnett, all of Richmond; Richard A. Thesing, Glenn Allen; Jose G. Nepomuceno, Richmond, all of Va.

[73] Assignee: Philip Morris Incorporated, New York, N.Y.

[21] Appl. No.: 723,883

[22] Filed: Apr. 16, 1985

Related U.S. Application Data

[63] Continuation-in-part of Ser. No. 457,505, Dec. 30, 1982, Pat. No. 4,510,950.

[51] Int. Cl.[4] ..... A24B 3/14

[52] U.S. Cl. ..... 131/355; 131/375

[58] Field of Search ..... 131/355, 375, 77

[56] References Cited

U.S. PATENT DOCUMENTS

| | | |
|---|---|---|
| 235,885 | 12/1880 | Lindsley . |
| 235,886 | 12/1880 | Lindsley . |
| T912,011 | 7/1973 | Harham . |
| 2,349,551 | 5/1944 | Helm . |
| 2,433,877 | 1/1948 | Wells et al. . |
| 2,445,338 | 7/1948 | Sowa . |
| 2,485,670 | 10/1949 | Sowa et al. . |
| 2,592,553 | 4/1952 | Frankenburg et al. . |
| 2,598,680 | 6/1952 | Frankenburg . |
| 2,708,175 | 5/1955 | Samfield et al. . |
| 2,845,933 | 8/1955 | Samfield et al. . |
| 3,012,562 | 12/1961 | Merritt . |
| 3,085,580 | 4/1963 | Muth . |
| 3,098,492 | 7/1963 | Wurzburg et al. . |
| 3,141,462 | 7/1964 | Block et al. . |
| 3,166,078 | 1/1965 | Parmele et al. . |
| 3,203,432 | 8/1965 | Green et al. . |
| 3,209,763 | 10/1965 | Parmele et al. . |
| 3,223,090 | 10/1965 | Strubel et al. . |
| 3,298,062 | 1/1967 | Nicholl . |
| 3,313,003 | 4/1967 | O'Brien . |
| 3,353,541 | 11/1967 | Hind et al. . |
| 3,364,935 | 1/1968 | Moshy et al. . |
| 3,373,751 | 3/1968 | Wallberg . |
| 3,404,690 | 10/1968 | Moshy et al. . |
| 3,404,691 | 10/1968 | Moshy et al. . |
| 3,410,279 | 11/1968 | Moshy et al. . |
| 3,411,515 | 11/1968 | Hind et al. . |
| 3,424,170 | 1/1969 | Grunwald et al. . |
| 3,467,109 | 9/1969 | Block et al. . |
| 3,528,434 | 9/1970 | Halter et al. . |
| 3,529,602 | 9/1970 | Hind et al. . |
| 3,613,693 | 10/1971 | Monte . |
| 3,760,815 | 9/1973 | Deszyck . |
| 3,820,548 | 6/1974 | Buchmann et al. . |
| 3,865,120 | 2/1975 | Detert et al. . |
| 3,894,544 | 7/1975 | Egri . |
| 3,931,824 | 1/1976 | Miano et al. . |
| 3,932,081 | 1/1976 | Buchmann et al. . |
| 3,968,804 | 7/1976 | Kelly et al. . |
| 3,983,884 | 10/1976 | Detert et al. . |
| 4,083,371 | 4/1978 | Beringer et al. . |
| 4,233,993 | 11/1980 | Miano et al. . |
| 4,333,484 | 6/1982 | Keritsis . |
| 4,340,072 | 7/1982 | Bolt et al. . |
| 4,347,855 | 9/1982 | Lanzillotti et al. . |
| 4,391,285 | 7/1983 | Burnett et al. . |
| 4,513,756 | 4/1985 | Pittman et al. . |

FOREIGN PATENT DOCUMENTS

| | | |
|---|---|---|
| 951209 | 7/1974 | Canada . |
| 1167717 | 4/1964 | Fed. Rep. of Germany . |
| 1532104 | 7/1969 | Fed. Rep. of Germany . |
| 2358657 | 7/1974 | Fed. Rep. of Germany . |
| 1782854 | 8/1974 | Fed. Rep. of Germany . |
| 2410168 | 9/1975 | Fed. Rep. of Germany . |
| 143799 | 11/1979 | Netherlands . |
| 690838 | 2/1969 | South Africa . |
| 0275420 | 5/1951 | Switzerland ..... 131/77 |
| 282369 | 11/1927 | United Kingdom . |
| 2064296 | 6/1981 | United Kingdom . |

*Primary Examiner*—V. Millin

*Attorney, Agent, or Firm*—Robert M. Isackson

[57] ABSTRACT

A substantially cylindrical foamed, extruded, tobacco-containing smoking article and a method of making the article. The article has properties substantially equivalent to a conventional cigarette. It contains from about 5 to about 98 wt. % of particulate tobacco, from 0 to about 60 wt. % of particulate filler, from about 2 to about 40 wt. % of a cellulosic binder selected from among hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof, and from about 5 to about 20 wt. % of water. The article has a density within the range of from about 0.05 to about 1.5 g/cc. The method of making such articles comprises the step of (a) dry blending the tobacco particles having an OV value of from about 3 to about 20% with from 0 to about 60 wt. % of a filler, and; (b) prehydrating the cellulosic binder material (c) admixing the prehydrated binder and the dry blend to form a wet blend containing from about 15 to about 50 wt. % of water; then (d) extruding the wet blend under extrusion conditions of temperature and pressure such that as the wet blend is extruded the moisture in the blend is converted to steam, thereby foaming the article.

26 Claims, No Drawings

FOAMED, EXTRUDED, TOBACCO-CONTAINING SMOKING ARTICLE AND METHOD OF MAKING THE SAME

CROSS REFERENCE TO RELATED APPLICATIONS

This application is a continuation-in-part of application Ser. No. 457,505 filed Dec. 30, 1982 now U.S. Pat. No. 4,510,950 by Gus D. Keritsis and Walter Allen Nichols entitled Foamed, Extruded, Tobacco-Containing Smoking Article And Method Of Making The Same.

BACKGROUND OF THE INVENTION

The present invention relates to improved tobacco-containing smoking articles and a method of making the same. More particularly, the present invention relates to foamed, extruded, tobacoo-containing smoking articles and to an improved method of making such articles.

It is known to make non-foamed, extruded, tobacoo-containing smoking articles such as are disclosed in commonly assigned U.S. Pat. No. 4,391,285 which issued July 5, 1983. The tobacco-containing smoking articles disclosed in that application are articles wherein tar delivery during combustion is controlled by adjusting the density, porosity, surface area or composition of the article. The article comprises a coherent mass of combustible tobacco-containing material having at least one through passage extending from a first opening in the surface of the mass to a second opening, remote from the first. The coherent mass is of a density and porosity such as to substantially occlude gas flow through the mass, while also being of porosity sufficient to support combustion of the mass when ignited.

A method of making the smoking articles of U.S. Pat. No. 4,391,285 is disclosed in commonly assigned U.S. Pat. No. 4,347,855 which issued Sept. 7, 1982. According to this method, a combustible tobacco material is mixed with one or more other ingredients, including a liquid, to provide a tobacco mixture which is then shaped under pressure into a discrete coherent mass; at least one passage is provided through the mass, and then the mass is dried. The mixture composition is selected and the shaping pressure and drying are controlled to impart to the mass a density and porosity such as to substantially occlude gas flow therethrough, and a porosity sufficient to support combustion of the shaped mass when it is ignited.

Formation of the coherent mass is preferably effected by extrusion of the tobacco mixture, which, for this purpose, preferably contains comminuted tobacco of mesh size less than about 30 mesh, and in an amount sufficient to provide a solids content in the mixture of from about 55 to about 75 weight percent. The burn characteristics of the tobacco article produced according to this method are improved by further processing the dry and coherent mass by re-wetting and subsequently re-drying the mass.

Commonly assigned U.S. Pat. No. 4,333,484, which issued June 8, 1982, discloses a modified cellulosic smoking material and a method for its preparation. The material does not contain tobacco and affords reduced particulate matter and puff count while having the flavor and aromatic qualities of natural tobacco. The smoking material comprises cellulosic material having incorporated therein a metal salt selected from the group consisting of calcium salts, magnesium salts, iron salts, and aluminum salts of various organic or inorganic acids. The cellulosic material is preferably selected from the group consisting of carboxymethyl cellulose and its salts, cross-linked carboxymethyl cellulose and its salts, methyl cellulose, hydroxypropyl methyl cellulose, hydroxypropyl cellulose, ethyl hydroxyethyl cellulose, ethyl cellulose, hydroxyethyl cellulose, and combinations thereof.

The method of making the smoking article comprises forming an aqueous slurry of the cellulosic material, preferably in the form of loose and slightly beaten cellulose fibers, adding from about 5 to 40 percent by weight, based on the cellulosic material, of the metal salt; adding a foaming or blowing agent to the resulting slurry under conditions which do not allow the foaming or blowing agent to foam the slurry; and casting or extruding the slurry and then drying the cast or extruded slurry under such conditions wherein the slurry is foamed during the casting or extruding step or during the drying step.

The organic acid is preferably selected from the group consisting of formic acid, acetic acid, propionic acid, butyric acid, valeric acid, methylvaleric acid, isovaleric acid, hexanoic acid, heptanoic acid, octanoic acid, benzoic acid, phenylacetic acid, citric acid, malic acid, tartaric acid, gluconic acid, and malonic acid and its lower alkyl derivatives, and combinations thereof. The inorganic acid is selected from the group consisting of hydrochloric acid, sulfuric acid, phosphoric acid, carbonic acid and combinations thereof.

The slurry may also include from about 3 to 40 percent by weight of an additive selected from the group consisting the pectins and their sodium, potassium, ammonium, calcium or magnesium salts, alginic acid and its sodium, potassium, ammonium, calcium or magnesium salts, and combinations thereof.

The foaming agent is preferably added to the slurry while the slurry is under sufficient pressure to prevent premature foaming of the slurry. The foaming agent is selected from the group consisting of air, steam, inert gases, volatile hydrocarbons, and combinations thereof. Preferably, the foaming agent is selected from a group consisting of ammonium carbonate, ammonium carbamate, azides, hydrazides, peroxides, azodiacarbonamide, and combinations thereof.

Among the objects of the present invention are the following:

to provide a foamed, extruded, tobacco-containing smoking article which exhibits superior combustion properties and taste, as compared to those smoking articles produced by the aforementioned methods having reduced binder content;

to provide an improved method of making such foamed, extruded, tobacco-containing smoking articles wherein the extrudate is stronger and dryer; and to extrude a tobacco-containing smoking article having a moisture content at or less than 25% OV, particularly less than 22% OV.

SUMMARY OF THE INVENTION

A substantially cylindrical, foamed, extruded, tobacco-containing smoking article is provided which has properties substantially equivalent to those of a conventional cigarette and which comprises from about 5 to about 98 wt. % tobacco particles having a particle size of up to about 5 mesh, from 0 to about 60 wt. % of a filler having a particle size of up to about 350 μm, from about 5 to about 20 wt. % water, and from about 2 to about 40 wt % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof; preferably hydroxypropyl cellulose, carboxymethyl cellulose or both. The article has a density within the range of from about 0.05 to about 1.5 g/cc, and a preferred diameter within the range of from about 2 to about 35 mm.

The article may also include from about 0.1 to about 15 wt. % of a polyfunctional acid, preferably citric acid, from about 0.001 to about 1 wt. % of an alcohol selected from the group consisting of ethanol, methanol, isopropanol, n-propanol and mixtures thereof, preferably ethanol, and may also desirably include from about 0.1 to about 40 wt. % of a cross-linking or stiffening agent.

A method of making such a foamed, extruded. tobacco-containing smoking article comprises the steps of (a) mixing together from about 5 to about 98 wt. % of communited tobacco particles having a particle size of up to about 5 mesh and an OV value of from about 3 to about 20%, from 0 to about 60 wt. % of a filler having a particle size of up to about 350 μm, from about 2 to about 40 wt. % of the cellulosic binder, and water to form a wet blend containing from about 15 to about 50 wt. % of water; then (b) extruding the wet blend from step (a) under extrusion conditions of temperature and pressure such that as the wet blend is extruded, the moisture in the wet blend is converted to steam, thereby foaming the article.

One embodiment of the method of making such a foamed, extruded, tobacco-containing smoking article as shown in the aforementioned application Ser. No. 457,505, copending and commonly assigned, comprises the steps of (a) dry blending from about 5 to about 98 wt. % of communited tobacco particles having a particle size of up to about 5 mesh and an OV value of from about 3 to about 20%, with from 0 to about 60 wt. % of a filler having a particle size of up to about 350 μm, and from about 2 to about 40 wt. % of the cellulosic binder; then (b) admixing this dry blend with water to form a wet blend containing from about 15 to about 50 wt. % of water; then (c) extruding the wet blend from step (b) under extrusion conditions of temperature and pressure such that as the wet blend is extruded, the moisture in the wet blend is converted to steam, thereby foaming the article.

An improved method of making such a foamed, extruded, tobacco containing smoking article, in accordance with this invention, comprises the steps of (1) dry blending (a) from about 2 to about 98 wt. % of tobacco particles having a particle size of up to about 5 mesh and an OV value of from about 3 to about 20% with (b) from 0 to about 60 wt. % of a filler having a particle size of up to about 350 μm, (2) prehydrating from about 2 to about 40 wt. % cellulosic binder with water or similar solvent to activate the adhesive character of the binder, (3) admixing the dry blend from step (1) with the prehydrated cellulosic binder from step (2) to form a wet blend containing from about 15 to about 50 wt. % of water, then (4) extruding the wet blend from step (3) into various shaped articles under extrusion conditions of temperature and pressure such that as the wet blend is extruded, the moisture in the blend is converted to steam, thereby foaming the article. Alternatively, a portion of the dry blend from step (1) could be prehydrated together with the binder from step (2) or a portion of the binder from step (2) could be dry blended with the ingredients from step (1). As used herein, the term "extrudate" refers to the wet blend of materials after they have reached the mixing barrel of the extruder.

DESCRIPTION OF THE PREFERRED EMBODIMENTS

The foamed, extruded, tobacco-containing smoking articles of the present invention contain, as essential ingredients, tobacco particles, water and a cellulosic binder that preferably has been prehydrated by admixing the binder with the water or similar solvent to activate the adhesive character of the binder, the binder being selected from the group consisting of hydroxypropyl cellulose, carboxymethyl cellulose, and its sodium, potassium and ammonium salts, cross-linked carboxymethyl cellulose, and its sodium, potassium and ammonium salts, hydroxypropyl methyl cellulose, methyl cellulose, ethyl cellulose, and mixtures thereof; preferably hydroxypropyl cellulose.

As the tobacco particles, communited tobacco selected from the group consisting of bright, burley, oriental, and mixtures thereof, communited reconstituted tobacco, communited stems, and tobacco dust or fines, may be employed. The tobacco may have been previously subjected to a stiffening or expansion process to increase its filling power. The smoking article comprises from about 5 to about 98 wt. % of the tobacco particles.

Whatever the source of the tobacco particles, the particles employed in the present invention will have a particle size of up to about 5 mesh. Preferably, the particle size will be less than 35 mesh, and more preferably will be less than 50 mesh. When particle sizes greater than 35 mesh are employed, it is desirable and may be necessary to add a polyfunctional acid, such as citric acid, during formation of the article in order to achieve the desired appearance and foaming of the extruded article. The polyfunctional acid is added in an amount such that the smoking article contains from about 0.1 to about 15 wt. % thereof, preferably from about 2 to about 10 wt. %.

The article may also include a filler, which is any particulate material having a particle size of up to about 350 μm and which is compatible with the other components of the blend. The filler is preferably selected from the group consisting of calcium carbonate, magnesium carbonate, calcium oxide, magnesium oxide, calcium hydroxide, magnesium hydroxide, alumina, hydrated alumina, clay, silica, diatomaceous earth and mixtures thereof; preferably calcium carbonate. When the filler is added, it is added in an amount preferably within the range of from about 5 to about 60 wt. % and the tobacco particles are added in an amount within the range of from about 2 to about 98 wt. %, preferably from about 25 to about 98 wt. %.

The cellulosic binder is present in an amount of from about 2 to about 40 wt. %, preferably from about 2 to about 20 wt. %. The cellulosic binder is preferably selected from the group consisting of hydroxypropyl cellulose, carboxymethyl cellulose, and hydroxyethyl cellulose, and mixtures thereof. A mixture of carboxymethyl cellulose and hydroxypropyl cellulose is particularly preferred.

The cellulosic binder, or a portion thereof, may be substituted with a compound (hereinafter "the compound") selected from the group consisting of starch, pectin and its sodium, potassium and ammonium salts, guar, guar derivatives, hemicellulose, and their derivatives, carboxymethyl, hydroxypropyl, and hydroxyethyl, curdlan, a salt of xanthamonas gum, carageenan, oxycellulose, polyvinyl alcohol, vinyl maleic anhydride polymer, a vinyl maleic acid polymer, and its sodium, potassium, and ammonium salts, microcrystalline cellulose, fibrous cellulose, chitin, chitosan and their derivatives, and mixtures thereof, such that the total amount of the compound plus the cellulosic binder falls within the ranges given for the cellulosic binder.

The smoking article contains from about 5 to about 20 wt. % water which is typically measured as oven volatiles (OV). Preferably, the smoking article contains from about 8 to about 17 wt. % water. This water, or moisture content, is selected in conjunction with the other weight ranges of additives in order to achieve the optimum degree of firmness and the optimum burn properties.

The smoking articles of the present invention have a density within the range of from about 0.05 to about 1.5 g/cc, preferably from about 0.10 to about 1.0 g/cc. The articles are foamed and thus comprise a porous structure which permits static burning and which also permits the passage of smoke through the article to the smoker without the provision of any passages through the article. The density of the article is related to the porous structure, and articles having densities within these ranges provide the optimum burn rate and transmission of smoke to the smoker.

The smoking articles may also include from about 0.001 to about 1 wt. % of an alcohol compatible with the cellulosic binder, that is, an alcohol in which the cellulosic binder is soluble, and which is selected from the group consisting of ethanol, methanol, isopropanol, n-propanol end mixtures thereof. The alcohol present in the smoking article is residual and results from a preferred practice of adding the alcohol during the formation of the article in order to lower the moisture content of the extrudate at the die, which provides a firmer, more easily handled product that requires less drying.

The smoking article may also contain from about 0.1 to about 40 wt. %, preferably from about 0.5 to about 20 wt. %, of a cross-linking or stiffening agent. The stiffening agent which is added prior to extrusion and then cross-linked during extrusion is selected from the group consisting of alginic acid, pectinic acid, chitosan, water soluble salts thereof, and mixtures thereof.

The smoking articles are preferably formed as substantially cylindrical rods having a diameter within a range of from about 2 to about 35 mm, preferably from about 4 to about 25 mm. Alternate cross sectional configurations may be made with an appropriate die, for example oval, star-shaped and the like. These rods are typically made in conventional cigarette or cigar lengths and may be wrapped with cigarette paper, a cigar wrapper, or the like. the article may be thus marketed as non-filtered "cigarettes" and as "cigars". A conventional filter may be joined to the "cigarette" by tipping paper to form a filtered smoking article.

Various flavorants, humectants, or both which are typically employed in the manufacture of smoking articles, may be added prior to extrusion or may be subsequently added to the foamed, extruded article before it is processed into a commercial product.

The method of the present invention comprises: (1) mixing together the tobacco particles the cellulosic binder and, optionally, the filler alcohol, the compound, the cross-linking or stiffening agent, and the polyfunctional acid with water or similar solvent capable of activating the adhesive character of the binder to form a wet blend, and (2) extruding the wet blend under extrusion conditions of temperature and pressure such that as the wet blend is extruded the moisture in the blend is converted to steam, thereby foaming the article as it exits the die of the extruder. As a preferred additional step, the extruded product of step is sized to a substantially cylindrical shape having a diameter of from about 2 to about 35 mm.

The improved embodiment of the method of the present invention comprises four steps, which are: (1) dry blending tobacco particles and, optionally, the filler, alcohol, the compound, the cross-linking or stiffening agent, and the polyfunctional acid; (2) prehydrating the cellulosic binder with water or similar solvent to activate the adhesive character of the binder; (3) admixing the dry blend with prehydrated cellulosic binder to form a wet blend; and (4) extruding the wet blend under extrusion conditions of temperature and pressure such that as the wet blend is extruded the moisture in the blend is converted to steam, thereby foaming the article as it exits the die of the extruder. As a preferred additional step (5), the extruded product of step (4) is sized to a substantially cylindrical shape having a diameter of from about 2 to about 35 mm.

In step (1), tobacco particles having a particle size of up to about 5 mesh and an OV value of from about 3 to about 20%, are dry blended with filler if any filler is to be added. While particle sizes larger than about 35 mesh can be employed, the use of such particles makes it desirable, and in some instances necessary, to employ from about 0.1 to about 15 wt. % of a polyfunctional acid such as citric acid. The polyfunctional acid acts to soften the tobacco particles, producing a more homogenous and elastic mixture. The polyfunctional acid may also be employed for the same purpose with mixtures using smaller particle sizes, but is not required. The polyfunctional acid is preferably selected from the group consisting of citric acid, malic acid, tartaric acid, ethyelene diamine tetraacetic acid, phosphoric acid, malonic acid and its $C_1$ and $C_4$ alkyl derivatives, and the sodium, potassium and ammonium salts of said acids. It is preferred to use particle sizes less than 35 mesh, and particularly preferred to use particle sizes of less than 50 mesh.

As the tobacco particles, any of the possible sources noted in connection with the discussion of the smoking article may be effectively employed. It is essential that the tobacco particles have an OV value within the range of from about 3 to about 20%, preferably from about 8 to about 17%. Thus when tobacco dust is used as the tobacco particle component of the dry blend, it may be necessary to add an amount of water during the dry blending step sufficient to achieve the required moisture content.

The optimal amount of prehydrated cellulosic binder present in the admixed wet blend will vary with the specific cellulosic binder used. For example, when hydroxypropyl cellulose is used as the only cellulosic binder, an optimal amount is at least about 8 wt. %. When hydroxypropyl cellulose is not included, an optimal amount of another cellulosic binder is at least about 10 wt. %. When hydroxypropyl cellulose is used in combination with another cellulosic binder, an optimal amount of hydroxypropyl cellulose is at least 1 wt. % in combination with at least 2 wt. % of the other cellulose binder(s) for a total amount within the range of from 3 to about 40 wt. %. The cellulosic binder, or a portion thereof, may be substituted with one of the above compounds, provided that the total amount of cellulosic binder and compound is within the above ranges.

An alcohol selected from the group consisting of ethanol, methanol, isopropanol, n-propanol, and mixtures thereof may be added to the mixture in the extruder, during the dry blending step or during the prehydration step, in an amount of from about 2 to about 40 wt. %, preferably from about 5 to about 15 wt. %, in order to lower the moisture content has been found to correlate with a firmer product, which is more easily handled and requires less drying.

In some instances, it may also be desirable to add a stiffening agent to the mixture, during the dry blending step or during the prehydration step, to produce a firmer product. The stiffening agent is added in an amount within the range of from about 0.1 to about 40 wt. %, preferably from about 0.5 about 20 wt. %, and is selected from the group consisting of alginic acid, pectinic acid, chitosan, carboxymethyl chitin, their water soluble salts, and mixtures thereof. Alginic acid is preferred. The stiffening agents cross link in the presence of heat with each other or with various cross-linking agents well known to those skilled in the art which are either present in the blend or which may be added for this specific purpose. By way of example, both alginic acid and pectinic acid will cross link with chitosan as well as with polyvalent metal ions such as calcium, and with amides. Chitosan will cross link with polyfunctional acids such as citric acid. These stiffening agents have been found to have the beneficial property of contributing to the subjective character of the smoke and thus may also be considered as flavorants. Although it is preferred to add these agents during the dry blending step, they may also be added during the prehydrating step (2), the admixing step (3), or immediately subsequent thereto. The dry blending step may occur in any conventional mixing device.

The cellulosic binder is prehydrated by blending the binder with sufficient water so that the wet blend resulting after step (3) contains from about 15 to about 50% water. The prehydrating step provides the water directly to the cellulosic binder materials where it is best utilized for activating the adhesive character of the binder efficiently, for forming the foamed extruded smoking article. The tobacco particles, being relatively more hygroscopic than the binder, tend to absorb more of the water than the binder when the binder and tobacco are dry blended together first, and water added second. This provides a wet extrudate having a significant amount of binder that is not activated and incompletely utilized. Consequently, either a larger than necessary amount of binder or an excessive amount of water, or both must be added to a dry blend of tobacco and binder to activate enough binder to form the product. The extrudate must be dried significantly, to reduce the water content to the desired level of between about 5 and 20 wt. % water for the smoking article.

Prehydrating the binder reduces the amount of water necessary to extrude the wet blended materials, resulting in a dryer and firmer extrudate. The tobacco does not absorb large amounts of water, that must later be removed by drying because the binder has already used most of the water. This also eliminates the need for special handling equipment required for the wetter non-prehydrated extrudate. Prehydration also reduces the amount of energy needed to dry the resulting extrudate to the desired moisture content because of its overall lower moisture content.

Prehydrating the binder also provides for a stronger extrudate than when a binder is not prehydrated. Because significantly more of the prehydrated binder is activated, there is a proportionately greater amount of adhesive activity which results in more binding and a more rigid product. By prehydrating the binder, a lesser amount of binder is needed to perform the binding function than the amount of binder required in the non prehydrated blend. Reducing the amount of binder is not only more economical but greatly improves the subjective quality factors of the resulting smoking article, for example, taste, feel, aroma, color, and quality of smoke.

Prehydrated binder is a viscous dough-like material. Because in some cases the viscosity may be too high for the conventional mixing apparatus at hand, it may be advantageous to add some of the dry blended materials of step (1) to the binder during the prehydrating step. Although the added dry blend of up to about half of the total tobacco weight will absorb some of the water, it will neither significantly interfere with prehydration of the binder nor raise the moisture content of the mass, but it will act as a lubricant to keep the dough-like mass within a workable, blendable, and extrudable viscosity range. Alternatively, some of the cellulosic binder materials in an unhydrated condition may be added to the mixture to be dry blended in step (1) with the balance of the binder being prehydrated. This too, will result in a relatively lower viscosity for the prehydrated binder as there will be some excess water in the prehydrated binder mass. Then, upon admixing the dry blend and prehydrated binder, the excess water is taken up by both the non-prehydrated binder and the tobacco present in the dry blend. In this alternative, most of the binder will be prehydrated so that any water absorbed by the tobacco is not significant compared to the resulting extrudate moisture content, and the admixed mass has a viscosity that can be extruded readily.

The prehydration of the binder, with or without a small portion of dry blend from step (1), is carried out in a conventional mixing device. The amount of water present in the wet blend is critical in that if the water content is reduced to less than about 15 wt. %, shear at the die of the extruder increases to the point that the surface of the extruded product becomes porous and rough, which results in a less than desirable degree of foaming. At water contents in excess of about 50 wt. %, without alteration of temperature, insufficient energy is supplied to the formulation to generate foam formation as the product exits the die.

Optionally, in step (1), in step (2) in step (3), or in step (4) a foaming agent may be added to the blend. The foaming agent is preferably selected from the group consisting of air, nitrogen, carbon dioxide, ammonium carbonate, ammonium carbamate, an azide, a hydrazide, pentane, hexane, heptane, a halogenated fluorocarbon, pyrrole, acetone, ethanol, a peroxide, and azodicarbonamide. Some of these foaming agents may require the addition of an acid or a base.

In step (4), the admixed wet blend is fed into an extruder and processed as set forth in greater detail below. The wet blend is extruded under extrusion conditions of temperature and pressure such that as the wet blend is extruded, the moisture in the blend is converted to steam, thereby foaming the article. Desirable extruders include commercially available single screw cooking extruders, which are high temperature/short time extruders that are essentially Archimedean pumps and which have heretofore been employed in the food industry, hydraulic piston extruders, ram extruders, and extruders employing an extrusion chamber consisting of a male auger and a sleeve which incorporates a female auger, a spacer ring, and a face plate (or die) to shape the foamed product. Preferred extruders include twin screw extruders having a positive displacement action, optionally having a plurality of multiple product feed ports along the length of the mixing chamber so that the prehydration of step (2) can occur in one segment of the mixing chamber, followed by the admixing of step (3) in the adjacent segment, followed by extrusion and foaming. A twin screw extruder may permit using less water than single screw extruders, perhaps because the positive displacement action is capable of processing more viscous masses. Screw tolerances and kneading blocks or forward and reversing paddles can be adjusted to select the net force pushing the material down the extrusion tube. The net force must be controlled to prevent overworking or cooking of the mixture, resulting in a dark colored product that will not foam properly, or underworking the mixture which results in an incompletely mixed and insufficiently foamed product. It is important that the tobacco particles and any preferred additional ingredients be mixed to form a homogeneous mixture prior to introduction into the feeding bin or in-feed port of an extruder.

The feeding bin is a starting point common to many single screw extruder systems and is typically located near the extruder with its purpose being to provide a continuous source of raw ingredients. The feeding bin receives material from a conventional mixer/surge system and it typically discharges into a variable speed metering/feeding device. A simple gravity bin with a bottom discharge may suffice for the ingredients employed in the step (3). Some feed assist means may be preferred depending on the viscosity of the mass.

A variable speed metering/feeding device is typically employed to take the wet blend away from the feeding bin and to transport it toward the extruder. This variable speed feeding device is a key link in the output of the extruder and sets the extrusion rate. Vibratory feeders and variable speed screw feeders are two commonly used metering/feeding devices.

An intermediary processing device may be utilized to prehydrate the binder, adding water, binder, and any other desired materials to form the dough-like viscous mass. This mass is then added to a second intermediary processing device to admix the prehydrated binder with the dry blend front step (1) in step (3). Continuous mixing of the dry blend with the prehydrated binder is accomplished in the processing device from which the wet blend is then fed directly into the extruder barrel.

When a twin screw extruder having multiple feed ports is used, typically one intermediary processing device will mix the binder materials together and feed it to a first feed port and a second intermediary processing device will mix the tobacco and other materials and feed it to a second port downstream of the first port. The respective feed rates are to be controlled to derive the desired proportions of binder to tobacco, to filler, etc., and water is added as needed, first to prehydrate the binder, and second maintain the moisture content above the 15% OV minimum, along the extruder barrel, as extrusion occurs.

While the feeding bin, variable speed metering/feeding device, and mixing cylinders are all of prime importance, the extruder itself is the article of the total system which fulfills the ultimate objective of working and shaping the product. The method will be further described with reference to both a single screw extruder and a twin screw extruder although other types of extruders may be effectively employed. The data and experiments described herein are the best results the inventors obtained. Other extruding equipment and conditions were used and, for the same or similar conditions, resulted in poorer results as measured by some product parameters. For example, insufficient mixing, inadequate foaming, and a feathered exterior appearance occurred in some instances. The inventors believe that the results recited herein are exemplary of their invention and that the poorer results occasionally obtained should be viewed as aberrational results due to equipment limitations.

The product is transported through the extruder barrel by the extruder screw(s), complemented by the closure around the screw which is referred to as the "head." The extruder head is jacketed, with the jacket being suitable for either electrical heating or the circulation of water, steam or other liquid thermofluid. This jacketing permits minor adjustments in the temperature profile of the extruder barrel by, for example, controlling the flow of the thermofluid within the head jacket. The vast majority of the thermoenergy within the extruder is created by the conversion of the mechanical energy into heat, but the use of jackets can give an added control and versatility feature.

It is preferred to establish and maintain a temperature gradient which increases along the length of the extruder barrel to a maximum at or just before the die within the range of from about 10° to about 300° C., more preferably about 50° to about 250° C. Thermocouples are typically installed through the head and into the product flow channel and are connected to either temperature indicators or to automatic temperature control systems for added control. Sensors for detecting the pressure of the extrudate within the barrel may be placed along the extruder barrel. Corresponding water input feeds may also be arranged along the barrel to add water when necessary to control the moisture level, for example, above the 15% or other desired minimum level to prevent the mixture from cooking or too high shear extrusion.

The extruder barrel may be built in segments or sections with the individual screws being separated by shear locks, which give each section its own discrete processing capability. Within the feed zone of the extruder barrel, the raw material exists as discrete particles. As these particles are transported forward in the feed zone, there is a positive pumping action with some compression of the material. This compression pushes the particles together into a more solid homogeneous mass.

As the material advances toward the die and into an additional zone or zones, this compression is continued and the material is subjected to mixing and mild shear, resulting in heating of the extrudate until the particles are transformed into a unitary dough-like mass. There is still a positive pumping effect in these zones that is somewhat less positive than in the feeding zone.

As the extrudate advances toward a final zone before the die, the extruder barrel becomes completely filled with product. Leakage flow and pressure flow are greatest within this final zone, resulting in higher viscous shearing, yielding maximum heat generation through friction. Heat is generated due to the friction of the particles rubbing against one another and due to the relative motion of the extrudate against screw and head surfaces.

The final die has two major functions. The first of these functions is to offer resistance to the forward flow of the product, thereby creating a condition where leakage flow and pressure flow may occur. Secondly, the die shapes the final product. The flow resistance of the die is the single greatest factor of the heat treatment given to the product because it has the greatest control over the pressure and, therefore, the shear created within the barrel. It is preferred to maintain a pressure at the die within the range of from about 50 to about 2500 psig, more preferably about 150 to about 1500 psig.

In the practice of the method of the present invention, it is preferred to employ a die having an orifice with a diameter within the range of from about 0.5 to about 50 mm, more preferably from about 2 to about 35 mm. Particularly preferred is a die orifice having a diameter within the range of from 3.2 to 3.8 mm.

Typically, foaming of the product occurs immediately after extrusion. This foaming is a result of the moisture or gas within the extrudate changing from a super heated liquid or compressed gaseous state to a gaseous state as the extrudate transfers from the high pressure environment behind the die to the atmospheric environment just outboard of the die openings.

The foamed product is typically extruded in the shape of a solid rod which is then sized, preferably to a substantially cylindrical shape having a diameter of from about 2 to about 35 mm, more preferably from about 4 to about 25 mm, dried by any conventional means, and then may be processed into completed smoking articles by wrapping with cigarette paper or the like, cutting the desired lengths, and, optionally, attaching a filter.

The article may be extruded into a tube or chamber which communicates with the sizing apparatus and defines the degree to which the article expands upon foaming. The article may also be further expanded by exposure to microwaves or heat which volatilize or decompose the foaming agent remaining in the sized article, thereby causing it to expand. The expansion may lead to increased open cell content and the reduction in pressure drop of the article.

While the preferred embodiment of the smoking article has been described in connection with the extrusion of a cylindrical foamed product, other foamed shapes such as sheets, oval or star-like columns, or spiral shapes could be extruded and formed into smoking articles. Variations in the die would be required for the extrusion of non-cylindrical shapes.

The following examples present illustrative but non-limiting embodiments of the present invention.

In each of the following examples, a short-time/high temperature extrusion cooker (Model X-20CF, manufactured by Wenger Manufacturing, Sabetha, Kans.) having a segmented screw and an extruder barrel flighted and segmented to provide five zones that can be independently steam heated or water cooled, was employed.

EXAMPLE 1

The following ingredients were dry blended:

454 g. (5%) Hydroxypropyl cellulose (Klucel® HF Hercules)

454 g. (5%) Carboxymethyl cellulose (CMC 7 HF Hercules)

816.5 g. (9%) Water 734.3 g. (81%) Tobacco dust (60–80 mesh)

and then fed to the low shear blender where it was admixed with 2540.2 g water, then fed to the extruder and the product extruded under the following conditions:

| Extrusion Conditions | | | |
|---|---|---|---|
| Zone 1 | 10° C. | Feeder RPM | 12.5 |
| Zone 2 | 60° C. | Low Shear Blender RPM | 300 |
| Zone 3 | 82° C. | Extruder Screw RPM | 400 |
| Zone 4 | 93° C. | Extruder Amps | 20 |
| Zone 5 | 104° C. | Die Orifice | 3.6 mm |
| | | Output | 82 kg./hr. |

EXAMPLE 2

The following ingredients were dry blended:

272.2 g. (3%) Hydroxypropyl cellulose (Klucel® HF Hercules)

272.2 g. (3%) Carboxymethyl cellulose (CMC 7 HF)

852.77 g. (9.4%) Water 7674.91 g. (84.6%) Tobacco Dust (60 mesh)

and then fed to the low shear blender where it was admixed with 2268 g. of water, then fed to the extruder and the product extruded under the following conditions:

| Extrusion Conditions | | | |
|---|---|---|---|
| Zone 1 | 10° C. | Feeder RPM | 12.5 |
| Zone 2 | 66° C. | Low Shear Blender RPM | 300 |
| Zone 3 | 82° C. | Extruder Screw RPM | 400 |
| Zone 4 | 91° C. | Extruder Amps | 20 |
| Zone 5 | 104° C. | Die Orifice | 3.6 mm |
| | | Output | 82 kg./hr. |

The resulting product was lower in tensile strength than the product of Example 1, but could be extruded and sized to a diameter of 7.20 mm. The density of the finished rod was 0.3 g/cc at a residual moisture content of 12%.

EXAMPLE 3

The following ingredients were dry blended:

1361 g. (15%) Hydroxyethyl cellulose 771.1 g. (8.5%) Water 6940.1 g. (76.5%) Tobacco Dust and then fed to the low shear blender where it was admixed with 3129.8 g. of water, then fed to the extruder and the product extruded under the following conditions:

| Extrusion Conditions | | | |
|---|---|---|---|
| Zone 1 | 13° C. | Feeder RPM | 12.5 |
| Zone 2 | 60° C. | Low Shear Blender RPM | 300 |
| Zone 3 | 77° C. | Extruder Screw RPM | 400 |
| Zone 4 | 110° C. | Extruder Amps | 21 |
| Zone 5 | 104° C. | Die Orifice | 3.6 mm |
| | | Output | 79 kg./hr. |

The resulting product was sized to a diameter of 8.0 mm and had a density of 0.25 g/cc at a residual moisture content of 12%.

Higher levels of hydroxyethyl cellulose may be used to achieve a product with lower density and increased strength.

EXAMPLE 4

The following ingredients were dry blended:

1814.4 g. (20%) Carboxymethyl cellulose (CMC 7 HF)

725.8 g. (8%) Water 6531.8 g. (72%) Tobacco Dust (60 mesh)

and then fed to the low shear blender where it was admixed with 5216.4 g. of water, then fed to the extruder and the product extruded under the following conditions:

| Extrusion Conditions | | | |
|---|---|---|---|
| Zone 1 | 10° C. | Feeder RPM | 125 |
| Zone 2 | 60° C. | Low Shear Blender RPM | 300 |
| Zone 3 | 82° C. | Extruder Screw RPM | 400 |
| Zone 4 | 93° C. | Extruder Amps | 21 |
| Zone 5 | 104° C. | Die Orifice | 3.6 mm |
| | | Output | 82 kg./hr. |

The resulting product was sized to a diameter of 6.8 mm and had a density of 0.32 g/cc at a residual moisture content of 12%. Rod surface texture was rough and highly porous.

Depending upon extrusion conditions, the carboxymethyl cellulose can be added in amounts as low as 10% by weight of the dry formulation.

EXAMPLE 5

The following ingredients were dry blended:

454 g. (5%) Hydroxypropyl cellulose (Klucel ® HF Hercules)

272.2 g. (3%) Carboxymethyl cellulose (CMC 7 HF)

181.4 g. (2%) Alginic Acid 453.6 g. (5%) Ethanol 771.1 g. (8.5%) Water 6940.1 g. (76.5%) Tobacco Dust (60 mesh)

and then fed to the low shear blender where it was admixed with 1678.3 g. of water, then fed to the extruder and the product extruded under the extrusion conditions of Example 1.

The resulting product had a moisture content of 19% at the die. (Typical formulations without ethanol range from 23% to 30% moisture content at the die.) The product was sized to 8.0 mm diameter and had a density of 0.23 g/cc at a moisture content of 12%.

Reducing the moisture content is advantageous in that if extrudate moisture is lower, the rod is firmer, more easily handled, and requires less drying.

EXAMPLE 6

The following ingredients were dry blended:

464 g. (5%) Hydroxypropyl Cellulose (Klucel ® HF Hercules)

272.2 g. (3%) Carboxymethyl cellulose (CMC 7 HF)

181.4 g. (2%) Alginic Acid 181.4 g. (2%) Citric Acid 798.34 g. (8.8%) Water 7185.02 g. (79.2%) Tobacco (35 mesh)

and then fed to the low shear blender where it was admixed with 2540.2 g. of water, then fed to the extruder and the product extruded under the following conditions:

| Extrusion Conditions | | | |
|---|---|---|---|
| Zone 1 | 16° C. | Feeder RPM | 125 |
| Zone 2 | 68° C. | Low Shear Blender RPM | 300 |
| Zone 3 | 91° C. | Extruder Screw RPM | 400 |
| Zone 4 | 96° C. | Extruder Amps | 18 |
| Zone 5 | 123° C. | Die Orifice | 3.6 mm |
| | | Output | 82 kg./hr. |

The resulting product was sized to a diameter of 7.5 mm. The rod density was 0.32 g/cc at a moisture content of 12% and the surface of the rod was rough and porous. Citric acid was used in the above formulation to help soften the tobacco particles.

Previous experimentation showed that material of large particle size (>35 mesh) tended to pierce the rod surface causing a release of steam before expansion due to foaming was complete. As particle size was reduced (>35 mesh), the need for citric acid was eliminated.

EXAMPLE 7

Four sample formulations (7A, 7B, 7C, and 7D) were each prepared by dry blending the following ingredients:

454 g. (5%) Hydroxypropyl cellulose (Klucel ® HF Hercules)

272.2 g. (3%) Carboxymethyl cellulose (CMC 7 HF)

181.4 g. (2%) Alginic Acid 816.5 g. (9%) Water 7348.3 g. (81%) Tobacco Dust (60 mesh)

and then feeding each blend to the low shear blender where it was admixed with 2540.2 g. of water, then fed to the extruder where each sample was extruded under the following conditions:

| Constant Extrusion Conditions | | | |
|---|---|---|---|
| Feeder RPM | 12.5 | Die Orifice | 3.6 mm |
| Low Shear Blender RMP | 300 | Out put | 82 kg./hr. |
| Extruder Screw RMP | 400 | | |
| Extruder Amps | 17.5 | | |

| Variable Extrusion Conditions | | | | | |
|---|---|---|---|---|---|
| Sample No. | Zone 1 | Zone 2 | Zone 3 | Zone 4 | Zone 5 |
| 7A | 10° C. | 49° C. | 71° C. | 82° C. | 93° C. |
| 7B | 10° C. | 77° C. | 99° C. | 110° C. | 121° C. |
| 7C | 10° C. | 93° C. | 116° C. | 127° C. | 138° C. |
| 7D | 10° C. | 107C | 127° C. | 138° C. | 143° C. |

As can be seen from the densities for the four samples:

| Sample No. | Density |
|---|---|
| 7A | .245 g/cc |
| 7B | .250 g/cc |
| 7C | .260 g/cc |
| 7D | .280 g/cc |

the temperature of the formulation in the extruder does not appreciably effect the rod density. Sample 7A, extruded at the lowest temperature, approaches the lower limit for foam formation when steam is employed as the foaming agent. If temperatures and pressures are insufficient for the creation of steam outside the die, foaming cannot take place. At increased temperatures, as in sample 7D, greater steam pressure and reduced film strength on the periphery of the product were observed resulting in creased surface porosity and decreased product diameter.

EXAMPLE 8

Four sample formulations (8A, 8B, 8C, and 8D) were each prepared by dry blending the following ingredients:

454 g. (5%) Hydroxypropyl cellulose (Klucel® HF Hercules)
454 g. (5%) Carboxymethyl cellulose (CMC 7 HF)
816.5 g. (8%) Water
7348.3 g. (81%) Tobacco Dust (60 mesh)

Different amounts of water were added to each dry blend such that the water content of each sample at the die was as follows:

| Sample No. | Total Water Content At Die |
|---|---|
| 8A | 27 wt. % |
| 8B | 29 wt. % |
| 8C | 32 wt. % |
| 8D | 34 wt. % |

Each sample was extruded under the following conditions:

| Extrusion Conditions | | | |
|---|---|---|---|
| Zone 1 | 60 | Feeder RPM | 12.5 |
| Zone 2 | 140 | Low Shear Blender RPM | 300 |
| Zone 3 | 180 | Extruder Screw RPM | 400 |
| Zone 4 | 200 | Extruder Amps | 21 |
| Zone 5 | 220 | Die Orifice | 3.6 mm |

resulting in products with the following densities:

| Sample No. | Product Density at 12% O.V. |
|---|---|
| 8A | .25 g/cc |
| 8B | .23 g/cc |
| 8C | .23 g/cc |
| 8D | .30 g/cc |

EXAMPLE 9

Sample cigarettes were prepared according to the method of the present invention and submitted for analytical testing. The results are summarized below.

| | Foamed Rod Cigarette | Conventional Cigarette* |
|---|---|---|
| TPM, mg/cigt. | 8.0 | 8.9 |
| FTC Tar, mg/cigt. | 6.5 | 7.3 |
| Nicotine, mg/cigt. | 0.45 | 0.59 |
| Water, mg/cigt. | 1.0 | 1.0 |

-continued

| | Foamed Rod Cigarette | Conventional Cigarette* |
|---|---|---|
| Puff Count | 8.4 | 7.9 |
| Tobacco Density, g/cc | 0.22 | 0.25 |
| Dilution, % | 35 | 34 |
| Total RTD, in. of $H_2O$ | 5.5 | 5.1 |

*The conventional cigarettes tested were made from a similar tobacco blend in shredded form.

As can be seen, the structural characteristics of a foamed tobacco rod do not affect its ability to perform like a conventional cigarette. The foam structure permits a greater degree of freedom in design, thus permitting a lower weight rod to be produced with properties equivalent to a conventional cigarette.

EXAMPLE 10

The following examples were conducted using a Baker-Perkins twin screw extruder, model MPF-50D having a 755.65 mm long extrusion chamber wherein the two screws had the same assemblage of components as follows:

| Length | Screw Assembly Element(s) |
|---|---|
| 6.35 mm | Spacer |
| 152.4 mm | Feed screws |
| 76.2 mm | Six 45° forwarding paddles |
| 50.8 mm | Super screw ($T_1$* = 15.5° C.) |
| 177.8 mm | Feed screws ($T_2$* = 15.67° C.) |
| 12.7 mm | One paddle |
| 50.8 mm | Single lead screw ($T_3$* = 65.5° C.) |
| 63.5 mm | Five 45° forwarding paddles |
| 12.7 mm | One orifice plug |
| 152.4 mm | Single lead screw ($T_4$* = 148.89° C.) |
| single die | 3.429 mm aperture/3.175 mm land ($T_5$* = 148.89° C.) |

*Temperature readings detected by a thermocouple.

The screws were rotated so as to be 90° out of phase to prevent interfering with each other and to provide a tolerance between the screws of about 50/64 mm.

The binder comprised 2 parts hydroxypropyl cellulose (Klucel® HF), 1 part carboxymethyl cellulose (CMC ®HF), and 1 part cereal binder (a pregelatinized corn starch). The binder material had a moisture content of 6.3% OV and a commercial tobacco blend dust was used. The Baker-Perkins extruder has multiple feed ports along its length, so auxillary mixing equipment was not required as it was in the Wenger extruder. The binder was added at a distance 679.45 mm from the die, the water used to prehydrate the binder was added at a distance 615.95 mm from the die, and the tobacco dust was added at a distance 425.45 mm from the die. The L:D ratio is 15:1 where the binder is added and 10:1 where the tobacco dust is added. The following runs were made at the extrusion conditions set forth in Table III below:

TABLE III

| Trial | Screw speed (RPM) | Wt (%)* binder | Binder feed rate (Kg/min) | Tobacco dust feed rate (kg/min) | OV (%) of blend in mixing chamber** | OV (%) extrudate | Velocity of extrusion (m/min) | Mass rate kg/Hr | Weight (mg/63 mm) |
|---|---|---|---|---|---|---|---|---|---|
| a | 400 | 10 | .009 | .816 | 20 | 14.3 | 55.47 | 47.62 | 864 |
| b | 400 | 10 | .009 | .816 | 18 | 11.6 | 58.82 | 48.99 | 864 |
| c | 490 | 10 | .1134 | 1.021 | 21 | 15.6 | — | 62.59 | — |
| d | 490 | 10 | .1134 | 1.021 | 23 | 17.2 | 91.44 | 102.06 | 830 |
| e | 490 | 8 | .1089 | 1.252 | 25 | 19.9 | 91.44 | — | 862 |

TABLE III-continued

| Trial | Screw speed (RPM) | Wt (%)* binder | Binder feed rate (Kg/min) | Tobacco dust feed rate (kg/min) | OV (%) of blend in mixing chamber** | OV (%) extrudate | Velocity of extrusion (m/min) | Mass rate kg/Hr | Weight (mg/63 mm) |
|---|---|---|---|---|---|---|---|---|---|
| control*** | 490 | 10 | .1134 | 1.021 | 27 | 21 | 137.16 | 72.57 | 670 |

*The amount of binder listed represents the minimum amount of binder that resulted in acceptable products
**The % OV in the mixing chamber is directly related to the water feed rate in the extruder barrel.
***The control comprised dry blending the tobacco particles and unhydrated binder, admixing the dry blend with water, and extruding the wet blend under the same extrusion conditions.

EXAMPLE 11

The following examples were extruded in the Baker-Perkins extruder under the following extrusion conditions.

| Length | Screw Assembly Elements |
|---|---|
| 6.325 mm | Spacer |
| 152.4 mm | Feed screws |
| 63.5 mm | Five 45° forwarding paddles |
| 50.8 mm | Short pitch feed screw ($T_1$ = 15.5° C.) |
| 177.8 mm | Feed screws ($T_2$ = 51.67° C.) |
| 12.7 mm | One paddle |
| 50.8 mm | Single lead screw ($T_3$ = 65.5° C.) |
| 63.5 mm | Five 45° forwarding paddles |
| 6.35 mm | One orifice plug |
| 50.8 mm | Single lead screw |
| 6.35 mm | One paddle |
| 101.6 mm | Single lead screw ($T_4$ = 148.89° C.) |
| single die | 3.505 mm aperture/3.175 mm land |

The same feed port arrangement and L:D ratios as used in Example 7 were used here. The binder mixture was selected from one of the three blends comprising:

| | | |
|---|---|---|
| Blend 1 (B1) | 2 parts | Hydroxypropyl cellulose (Klucel-HF) ® |
| | 1 part | Carboxymethyl cellulose (CMC ®HF) |
| | 1 part | Cereal binder |
| Blend 2 (B2) | 2 parts | Hydroxypropyl cellulose (Klucel-M) ® |
| | 1 part | Carboxymethyl cellulose (CMC ®HF) |
| | 1 part | Cereal binder |
| Blend 3 (B3) | 1 part | Hydroxypropyl cellulose (Klucel-H) ® |
| | 1 part | Hydroxypropyl cellulose (Klucel-J) ® |

The results of the various extrusions are set forth in Table IV below:

unit length. The results of Example 11 show generally that the prehydrated binder blends have somewhat higher resistance to draw with about the same rod circumference for the same amount of binder as the control. In general, the resulting product from prehydrated binders were stronger and had less moisture than non-prehydrated binders, thus requiring less amount of binder overall and less time to dry the extrudate. Compare Run 11c having 8 wt. % binder to the control having 10 wt. % binder where it appears that using less binder in a prehydrated state results in having about the same moisture content, a comparable resistance to draw, a larger rod circumference, and a greater weight, mass rate, and velocity of extrusion. The product also had a lighter color, probably because the prehydration prevented the tobacco from absorbing much water which probably resulted from not overcooking the extrudate.

We claim:

1. A method of making a foamed, extruded, tobacco-containing smoking article, comprising the steps of:

(a) mixing together from about 5 to about 98 wt. % of tobacco particles having a particle size of up to about 5 mesh and an OV value of from about 3 to about 20%, from 0 to about 60 wt. % of a filler having a particle size of up to about 350 μm, from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof; and an amount of water to form a wet blend containing from about 15 to about 50 wt. % of water; then (b) extruding the wet blend from step (a) under extrusion conditions of temperature and pressure such that as the wet blend is extruded the moisture in

TABLE IV

| Sample | Screw speed (RPM) | Binder blend | Wt. % binder blend* | Binder feed rate (Kg/min) | Tobacco dust feed rate (Kg/min) | OV (%) of blend in mixing chamber** | OV (%) extrudate | Velocity of extrusion (m/min) | Mass rate (kg/hr) | Weight per 63 mm (mg) | Resistance to draw (in) | Rod circumference (mm) |
|---|---|---|---|---|---|---|---|---|---|---|---|---|
| a | 490 | B1 | 12 | .1089 | .798 | 26 | 18.2 | 107 | 68.04 | 763 | 3.83 | 25.33 |
| b | 490 | B1 | 10 | .136 | 1.225 | 26 | 17.6 | 166 | 108.86 | 788 | 4.31 | 25.87 |
| c | 490 | B1 | 8 | .1089 | 1.252 | 27 | 21.2 | 166 | 102.06 | 745 | 3.48 | 26.02 |
| d | 490 | B1 | 7 | .0953 | 1.265 | 27.75 | 21.9 | 166 | 99.34 | 735 | 3.37 | 25.61 |
| e | 490 | B2 | 10 | .136 | 1.225 | 27.75 | 20.4 | 166 | 92.53 | 716 | 3.65 | 26.14 |
| f | 490 | B3 | 12 | .1633 | 1.197 | 27 | 15.4 | 166 | 115.67 | 810 | 2.38 | 25.37 |
| g | 490 | B3 | 12 | .1633 | 1.197 | 25 | 15.1 | 152.4 | 95.25 | 823 | 1.94 | 25.37 |
| control*** | 490 | B1 | 10 | .1134 | 1.021 | 27 | 21 | 137.16 | 72.57 | 670 | 3–3.5 | 24.7 |

*The amount of binder used represents the minimum amount of binder that could be used to produce an acceptable result.
**The % OV in the mixing chamber is directly related to the water feed rate in the extruder barrel.
***The control comprised dry blending the tobacco particles and unhydrated binder, admixing the dry blend with water, and extruding the wet blend under the same extrusion conditions. The resistance to draw and rod circumference values were not measured but are expected values for the control under the given conditions.

These results show that Runs 10c, 10d and 11b, when compared to the control, had a lower OV content in the mixing barrel and as extruded, and a greater weight per said blend is converted to steam, thereby foaming the article.

2. The method of claim 1 wherein the filler is selected from the group consisting of calcium carbonate, magnesium carbonate, calcium oxide, magnesium oxide, calcium hydroxide, magnesium hydroxide, alumina, hydrated alumina, clay, silica, diatomaceous earth, and mixtures thereof.

3. The method of claim 1 including adding in step (a) a compound selected from the group consisting of starch, pectin and its sodium, potassium and ammonium salts, guar, modified guar, hydroxypropyl guar, carageenan, alginic acid and its ammonium, sodium, and potassium salts, oxycellulose, polyvinyl alcohol, vinyl maleic anhydride polymer, vinyl maleic acid polymer and its sodium, potassium, and ammonium salts, microcrystalline cellulose, fibrous cellulose and mixtures thereof, such that the total amount of the compound and the cellulosic binder is within the range of from about 2 to about 40 wt. %.

4. The method of claim 3 wherein all of the cellulosic binder is replaced by the compound such that the total amount of the compound added is within the range of from about 2 to about 40 wt. %.

5. The method of claim 1 including as a further step:

(c) sizing the extrudate from step (b) to a substantially cylindrical shape having a diameter of from about 2 to about 35 mm.

6. The method of claim 1 including, in step (a), from 0.1 to about 15 wt. % of a polyfunctional acid.

7. The method of claim 6 wherein the polyfunctional acid is citric acid.

8. The method of claim 1 including, in step (a), from about 0.1 to about 40 wt. % of a stiffening agent selected from the group consisting of alginic acid, pectinic acid, chitosan, carboxymethyl chitin, their water soluble salts, and mixtures thereof.

9. The method of claim 1 including, in step (a), from about 2 to about 40 wt. % of an alcohol selected from the group consisting of ethanol, methanol, isopropanol, n-propanol, and mixtures thereof.

10. The method of claim 1 where the tobacco particles in step (a) comprise from about 50 to about 98 wt. %.

11. The method of claim 1 including in step (b), adding water to the extrudate to maintain the OV valve between about 15% and about 50% during extrusion.

12. A foamed extrudate produced according to the method of claim 1 having a moisture content below 25% OV as extruded.

13. A smoking article produced according to the method of claim 1.

14. A method of making a foamed, extruded, tobacco-containing smoking article, comprising the steps of:

(a) dry blending from about 5 to about 98 wt. % of tobacco particles having a particle size of up to about 5 mesh and an OV value of from about 3 to about 20%, with from 0 to about 60 wt. % of a filler having a particle size of up to about 350 μm;

(b) prehydrating from about 2 to about 40 wt. % of a cellulosic binder selected from the group consisting of hydroxypropyl cellulose, carboxymethyl cellulose, and its sodium, potassium and ammonium salts, cross-linked carboxymethyl cellulose, and its sodium, potassium and ammonium salts, hydroxyethyl cellulose, ethyl hydroxyethyl cellulose, hydroxypropyl methyl cellulose, methyl cellulose, ethyl cellulose, and mixtures thereof;

(c) admixing the dry blend from step (a) and the prehydrated binder from step (b) to form a wet blend containing from about 15 to about 50 wt. % of water; then (d) extruding the wet blend from step (c) under extrusion conditions of temperature and pressure such that as the wet blend is extruded the moisture in said blend is converted to steam, thereby foaming the article.

15. The method of claim 14 wherein the filler is selected from the group consisting of calcium carbonate, magnesium carbonate, calcium oxide, magnesium oxide, calcium hydroxide, magnesium hydroxide, alumina, hydrated alumina, clay, silica, diatomaceous earth and mixtures thereof.

16. The method of claim 14 including adding before step (d) a compound selected from the group consisting of starch, pectin and its sodium, potassium and ammonium salts, guar, modified guar, hydroxypropyl guar, carageenan, alginic acid and its ammonium, sodium, and potassium salts, oxycellulose, polyvinyl alcohol, vinyl maleic anhydride polymer, vinyl maleic acid polymer and its sodium, potassium, and ammonium salts, microcrystalline cellulose, fibrous cellulose and mixtures thereof, such that the total amount of the compound and the cellulosic binder is within the range of from about 2 to about 40 wt. %.

17. The method of claim 14 wherein all of the cellulosic binder is replaced by the compound such that the total amount of the compound added is within the range of from about 2 to about 40 wt. %.

18. The method of claim 14 including as a further step:

(e) sizing the extrudate from step (c) to a substantially cylindrical shape having a diameter of from about 2 to about 35 mm.

19. The method of claim 14 including, in step (a), from 0.1 to about 15 wt. % of a polyfunctional acid.

20. The method of claim 19 wherein the polyfunctional acid is citric acid.

21. The method of claim 14 including, in step (a), from about 0.1 to about 40 wt. % of a stiffening agent selected from the group consisting of alginic acid, pectinic acid, chitosan, carboxymethyl chitin, their water soluble salts, and mixtures thereof.

22. The method of claim 14 including, adding before step (d), from about 2 to about 40 wt. % of an alcohol selected from the group consisting of ethanol, methanol, isopropanol, n-propanol, and mixtures thereof.

23. The method of claim 14 where the tobacco particles in step (a) comprise from about 50 to about 98 wt. %.

24. The method of claim 14 including in Step (d), adding water to the extrudate to maintain the OV value between about 15% and about 50% during extrusion.

25. A smoking article produced according to the method of claim 14.

26. A foamed extrudate produced according to the method of claim 14 having a moisture content less than 25% OV as extruded.

* * * * *